United States Patent [19]

Nishimura

[11] 4,034,769

[45] July 12, 1977

[54] FINGERNAIL POLISHING APPARATUS

[76] Inventor: Koichi Nishimura, 13 - 4 Kitashinjuku 1-chome, Shinjuku, Tokyo, Japan, 160

[21] Appl. No.: 711,375

[22] Filed: Aug. 3, 1976

[30] Foreign Application Priority Data

Apr. 24, 1976 Japan ..... 51-5151509[U]

[51] Int. Cl.[2] ..... A45D 29/04

[52] U.S. Cl. ..... 132/76.4

[58] Field of Search ..... 132/76.4, 75.6, 73

[56] References Cited

U.S. PATENT DOCUMENTS

| | | | |
|---|---|---|---|
| 2,225,567 | 12/1940 | Neuschaefer | 132/76.4 |
| 2,288,002 | 6/1942 | Kingman | 132/76.4 |
| 3,866,618 | 2/1975 | Tsukamoto | 132/76.4 |

*Primary Examiner*—G.E. McNeill

*Attorney, Agent, or Firm*—Wenderoth, Lind & Ponack

[57] ABSTRACT

A fingernail polishing apparatus for use in the manicure treatment comprises in combination a plurality of polishing sheets having specific filing or polishing functions which depend upon the purpose of treating a fingernail. The sheets are made of elastic base material having thereon a coating of a mixture composed of abrasive media of varying grain sizes, a synthetic resin adhesive and different colorant material.

8 Claims, 7 Drawing Figures

FINGERNAIL POLISHING APPARATUS

BACKGROUND OF THE INVENTION

1. Field of the Invention

This invention relates generally to a manicure treatment apparatus, and more particularly to a fingernail polishing apparatus which comprises in combination a plurality of polishing sheets having specific filing or polishing functions which depend upon the purpose of treating a fingernail, such as rough shaping to final gloss polishing. The sheets may be employed in a stepwise or random way, depending upon the motive of the user.

2. Description of the Prior Art

Various fingernail filing or polishing devices of the type enclosed herein for use in manicure treatment are known. As it is commonly known, nail scissors or nippers are available specifically for cutting or trimming fingernails. Some include a roughly notched surface on a part of at least one blade member thereof however this provides only a single function of shaping a fingernail roughly, and it is therefore not intended to make the nail smooth and glossy. Another device is in the form of different powdered abrasives which are separately contained in a bag or box. They may serve multiple functions, but have a disadvantage in that they are very difficult to carry it. A further known device has the three-layer form which consists of a base sheet, an intermediate elastic material and a tape-like abrasive media attached by adhesive material. This has a problem in that it is unhandy.

SUMMARY OF THE INVENTION

In light of the disadvantages and problems of the prior art mentioned above, it is accordingly one object of the present invention to provide a multifunction fingernail polishing apparatus which comprises a plurality of filing or polishing sheets each having a different stage function according to the purpose of treating a fingernail, such as rough shaping to final gloss polishing.

Another object of the present invention is to provide a fingernail polishing apparatus which comprises a plurality of filing or polishing sheets each including a base sheet of elastic material such as foamed styrol and a coating of abrasive media of varying grain sizes applied to one ot both faces of the base sheet.

Still another object of the present invention is to provide a fingernail polishing apparatus which comprises a plurality of abrasive sheets, each carrying a coating of filing or polishing media composed of a mixture of hard fine particle substances of varying grain size, synthetic resin adhesive and different colorant material.

A further object of the present invention is to provide a fingernail polishing apparatus which includes means for distinguising the different functions according to the purpose of the treatment.

A still further object of the present invention is to provide a fingernail polishing apparatus which permits easier handling.

A still further object of the present invention is to provide a fingernail polishing apparatus which permits less costly manufacture thereof an automatic and mass production basis.

In accordance with the invention briefly described above, there are a plurality of filing or polishing sheets formed to appropriate shape and thickness, each having a coating of abrasive media of a different function and colored differently to distinguish the functions according to the specific purpose of the sheets. The apparatus according to the invention permits a stepwise or random treatment of the fingernails.

BRIEF DESCRIPTION OF DRAWING

Those and other objects, features and advantages of the present invention will become apparent from the following parts of the specification hereinafter, the appended claims and the accompanying drawings, in which:

DESCRIPTION OF THE PREFERRED EMBODIMENTS

Figure 1:
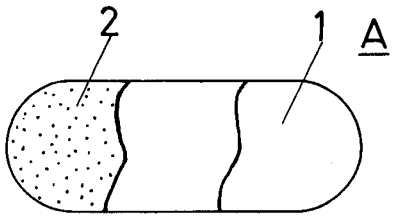
FIG. 1 is a plan view showing, partly broken away, a rough-shaping sheet according to the invention.
Figure 2:
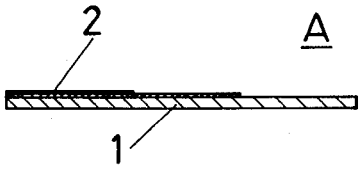
FIG. 2 is a sectional view of the first sheet shown in FIG. 1.
Figure 3:
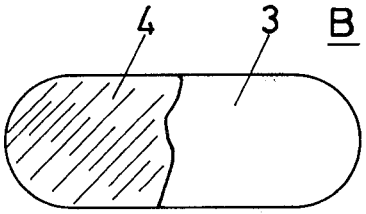
FIG. 3 is a plan view showing, partly broken away, a medium-polishing sheet according to the invention.
Figure 4:
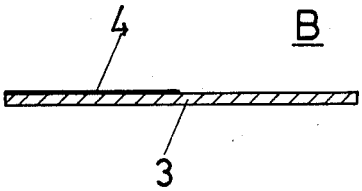
FIG. 4 is a sectional view of the second sheet shown in FIG. 3.
Figure 5:
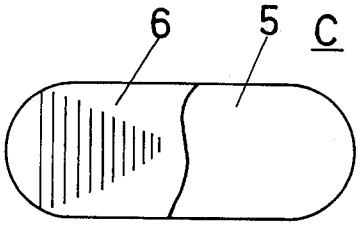
FIG. 5 is a plan view showing, partly broken away, a third gloss-making sheet according to the invention.
Figure 6:
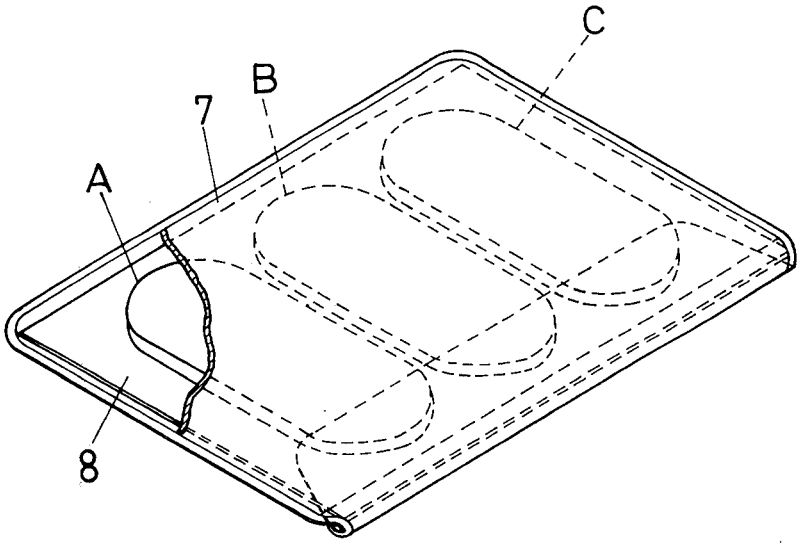
FIG. 6 is a perspective view illustrating a set of the three sheets enclosed in a transparent bag.

The invention will further be illustrated by the way of example only with reference to the accompanying drawings. In FIG. 1, a first sheet, generally shown by A, has the function of shaping a fingernail roughly and includes a base sheet 1 of a substantially elliptical shape in plane made of elastic material such as, example, foamed styrol and a coating of abrasive or filing media 2 applied to, for example, one face of the base sheet 1. The abrasive media 2 is composed of a mixture of a hard fine particle substance of relatively coarse grain size, a synthetic resin adhesive and a coloring material such as black. The mixture has the form of powder, and is applied to the surface of the base material 1 by means a coating method to form an abrasive layer shown by 2. In an alternative form, the abrasive media 2 may have the form of a tape cut to the shape of the base sheet 1 and applied thereto. A second sheet, generally shown by B, has the function of polishing the fingernail to a medium degree. As particularly shown in FIG. 3, the sheet B includes a base sheet 3 made of elastic material such as foamed styrol and a coating of polishing media 4 applied to one face of the base sheet 3. The polishing media 4 is composed of a mixture of a hard fine particle substances of smaller grain size than the sheet A, a synthetic resin adhesive and a coloring material for example orange. The mixture in the form of powder is applied to the face of the base sheet 3 by a coating method to form a layer of abrasive media 4. In FIG. 5, a third sheet generally shown by C services the functon of making the fingernail smooth and glossy, and includes a base sheet 5 of elastic material such as foamed styrol and a coating of gloss-making media 6 applied to one face of the base sheet 5. The gloss-making media comprises a mixture composed of a hard fine particle substances of the smallest grain size, a synthetic resin adhesive and a coloring material for example pink. As in the two earlier sheets A and B, the mixture has the form of powder, which is applied to the face of the base sheet 5 by a coating method to form a layer of abrasive media 6. The sheets B and C have the similar shape to the sheet A. In the above embodiment, a coating of the abrasive media of various grain sizes is applied to one face of the base sheet, but may be applied to both faces. This may apply to a varied form which will be described later. The sheets A, B, and C forming a set thereof are held in position in a transparent bag, box or the like. In the drawing, reference numeral 8 denotes a slip placed in the bag for illustrating the mode for use.

Figure 7:
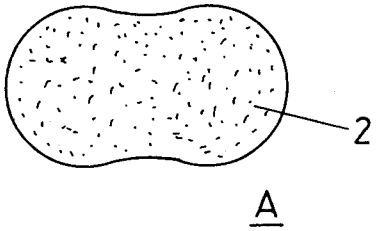
FIG. 7 is a plan view of a first sheet of a varied shape according to the invention.

In the above embodiment, a set of three sheets A, B and C of distinct colors such as black, orange and pink according to the different functions of the sheets have been described, but two more sheets of different colors such as green and yellow may be added, and may serve different functions from the earlier sheets A, B and C. In this varied form, the two additional sheets may have a coating of abrasive media which contains a hard fine particle substance of different grain size from those described earlier. In more detail, one (green color) may polish the nail more finely than the sheet B, and the other (yellow color) may polish the nail more finely than the green color sheet. Thus, a set of five sheets may be available and provide a wider choice of the various functions ranging from the initial rough shaping through intermediate polishing steps to final smooth and glossy finishing. In a further varied form of the earlier embodiments, the sheet C may have a coating of leather or cloth attached by adhesive, which can better polish the nail as the finish treatment. In FIG. 7, a varied form of the first sheet A is shown; it has a substantially elliptical shape and is provided with a recessed portion on both sides. This makes it easy for the sheet to be held by fingers and to be manipulated for the fingernail treatment. The other sheets B, C, etc. may have the similar shape. It should be understood that the materials used for the base sheet and abrasive media are not limited to the embodiments described above, respectively.

All the sheets according to the present invention have a base sheet of elastic material such as formed styrol cut to appropriate shape and thickness which makes the sheet fit or agree with the fingernails. Because of their snug and uniform contact with the curved edges of the fingernails, the sheets permit a nail polishing treatment with great easiness and accuracy, resulting finally in a smoothly polished nail. Since the coating of abrasive media applied to the base sheets comprises a mixture composed of powdered abrasive substances of varying grain sizes, and can thus be effected with easiness, a less costly manufacture can be achieved on an automatic and mass production basis. A further advantage of the invention is the provision of distinguishing means by color according to the function of the sheets. This eliminates the need of trying any one of the sheets to make sure that it fits the specific needs of the user such as rough shaping, medium polishing and finish polishing. Accordingly, a proper choice can be made without loss of time and error. A still further advantage is the combination of the multi-functions which can be selected according to the step of the treatment. This permits an extremely delicate treatment or care of the fingernails depending upon the condition of the fingernails. As noted from the above, the invention may form a part of the manicure treatment, and offers a tool therefor.

Although the invention has been illustrated by showing the several preferred embodiments thereof, it should be understood that various changes and modifications may be made without departing from the spirit and scope of the invention.

What is claimed:

1. A fingernail polishing apparatus for use in the treatment of fingernails in a stepwise manner or in a random nanner depending upon the purpose of treating fingernails, the treatment covering the range of from an initial rough shaping to a final gloss making, said apparatus comprising, in combination:

a plurality of fingernail polishing means having the form of a sheet and having specific functions which depend upon the purpose of treating a fingernail, each of said plurality of polishing means comprising:

1. a base sheet made of elastic material cut to appropriate shape and thickness; and
2. a coating of abrasive media applied to said base sheet, said abrasive media comprising a mixture composed of abrasive material of varying grain size depending upon the function of said polishing means, adhesive material and distinguishing means.

2. An apparatus as defined in claim 1, wherein said abrasive material comprises a hard fine particle substance of varying grain size depending upon the purpose of treating the fingernail.

3. An apparatus as defined in claim 1, wherein said distinguishing means comprises a coloring material of a different character depending upon the function of said polishing means.

4. An apparatus as defined in claim 1, wherein said coating of said abrasive media is applied to one face of said polishing means.

5. An apparatus as defined in claim 1, wherein said coating of said abrasive media is applied to both faces of said polishing means.

6. An apparatus as defined in claim 1, wherein said plurality of fingernail polishing means comprises three sheets, a first sheet intended for rough shaping, a second sheet for medium polishing and a third sheet for smooth and glossy making.

7. An apparatus as defined in claim 1, wherein said elastic material comprises a foamed styrol material shaped to said base sheet of a substantially elliptical form in plane.

8. An apparatus as defined in claim 1, wherein said elastic material comprises a foamed styrol material shaped to said base sheet of a substantially elliptical form in plane provided with a recessed portion on both sides.

* * * * *